US006496987B1

(12) United States Patent
Chou

(10) Patent No.: US 6,496,987 B1
(45) Date of Patent: Dec. 24, 2002

(54) WATER-SAVING AND AUTOMATIC DETERGENT SUPPLIER FOR TOILET BOWL

(76) Inventor: Ming-Hsiung Chou, 5F, No. 76, Lane 108, Lungchiuan St., Banchiau City, Taipei (TW)

( * ) Notice: Subject to any disclaimer, the term of this patent is extended or adjusted under 35 U.S.C. 154(b) by 0 days.

(21) Appl. No.: 10/052,536

(22) Filed: Jan. 23, 2002

(51) Int. Cl.[7] ..... E03D 9/02
(52) U.S. Cl. ..... 4/227.2; 4/227.3
(58) Field of Search ..... 4/227.1–227.7, 4/225.1, 226.1, 363

(56) References Cited

U.S. PATENT DOCUMENTS 507,656 A * 10/1893 Kato, Jr. et al. ..... 4/227.1
2,320,128 A * 5/1943 Hall ..... 4/227.3
2,520,056 A * 8/1950 Pozun ..... 4/227.1
2,620,097 A * 12/1952 Titmas ..... 4/227.3
4,066,187 A * 1/1978 Nieman et al. ..... 4/227.3
4,285,074 A * 8/1981 Leinberry ..... 4/227.3
4,696,414 A * 9/1987 Huat ..... 4/227.3
5,551,095 A * 9/1996 Chen ..... 4/227.3
5,642,533 A * 7/1997 Young ..... 4/363

* cited by examiner

*Primary Examiner*—Charles R. Eloshway
(74) *Attorney, Agent, or Firm*—Rosenberg, Klein & Lee

(57) ABSTRACT

Water-saving and automatic detergent supplier for toilet bowl, including: a detergent receptacle disposed in a water tank of the toilet bowl, the detergent receptacle being a container having an upper opening for containing a detergent; a quantitative reservoir connected with a bottom of the detergent receptacle and immersed in the water contained in the water tank, a top end of the quantitative reservoir being formed with a detergent inlet, while a bottom end of the quantitative reservoir being formed with a detergent outlet; and a buoyant piston structure connected at the detergent inlet and detergent outlet. The buoyant piston structure is subject to water buoyancy, whereby depending on the existence of water in the water tank or vacancy of the water tank, the buoyant piston structure is operable to release the detergent from the quantitative reservoir into the water tank.

5 Claims, 9 Drawing Sheets

WATER-SAVING AND AUTOMATIC DETERGENT SUPPLIER FOR TOILET BOWL

BACKGROUND OF THE INVENTION

1. Field of the Invention

The present invention is related to a water-saving and automatic detergent supplier for toilet bowl. The automatic detergent supplier is disposed in a water tank of the toilet bowl to save water for flushing the toilet bowl and automatically quantitatively supply detergent for cleaning the toilet bowl. The automatic detergent supplier can be used without contaminating the water tank.

2. Description of the Prior Art

Various kinds of toilet detergent liquids or detergent tablets are commercially available. Such toilet detergent is placed in the water tank of the toilet bowl. Each time the toilet bowl is flushed, the detergent is automatically entrained by the water to clean the toilet bowl. However, after the detergent is exhausted, it is necessary for a user to add new detergent into the water tank. Such procedure is quite troublesome.

Moreover, the detergent tablet is a solid body which is gradually resolved in the water to form the detergent solution. However, the detergent tablet is resolved at slow rate so that in the case that the toilet bowl is too closely used, the cleaning effect will be poor. Furthermore, in the beginning of use of the detergent tablet, the density of the detergent solution will be thicker. However, the density of the detergent solution will become thinner and thinner with the increment of using times. Therefore, it is impossible to supply fixed density of detergent for the toilet bowl. In addition, after the detergent tablet is fully resolved, the remainder thereof will stick on the bottom of the water tank and can be hardly cleared up.

SUMMARY OF THE INVENTION

It is therefore a primary object of the present invention to provide a water-saving and automatic detergent supplier for toilet bowl, which is disposed in a water tank of the toilet bowl to save water for flushing the toilet bowl. Each time flushing the toilet bowl, the detergent supplier is able to automatically quantitatively supply the detergent to the toilet bowl for cleaning the same.

According to the above object, the water-saving and automatic detergent supplier for toilet bowl of the present invention includes: a detergent receptacle disposed in a water tank of the toilet bowl, the detergent receptacle being a container having an upper opening; a quantitative reservoir connected with a bottom of the detergent receptacle, a top end of the quantitative reservoir being formed with a detergent inlet, while a bottom end of the quantitative reservoir being formed with a detergent outlet; and a buoyant piston structure connected at the detergent inlet and detergent outlet. The buoyant piston structure is subject to water buoyancy, whereby depending on the existence of water in the water tank or vacancy of the water tank, the buoyant piston -structure is operable to release the detergent from the quantitative reservoir into the water tank.

The water-saving and automatic detergent supplier further includes a fixing structure connected with the detergent receptacle for fixing the same in a certain position in the water tank. The fixing structure includes at least one fixing rod connected with the top end of the detergent receptacle.

A hook member is disposed at each end of the fixing rod for hooking a peripheral wall defining an upper opening of the water tank. An upper cover board of the water tank serves to press the hook members.

In the water-saving and automatic detergent supplier, the buoyant piston structure includes an upper piston, a lower piston and a buoyant body. The upper piston is disposed on upper side of the detergent inlet of the quantitative reservoir, while the lower piston is disposed on lower side of the detergent outlet of the quantitative reservoir. The upper and lower pistons are both drivingly connected with the buoyant body. In a full level state of the water tank, due to water buoyancy, the buoyant body makes the lower piston block the detergent outlet, while opening the upper piston to unblock the detergent inlet. Under such circumstance, the detergent is filled up into the quantitative reservoir. On the other hand, in a vacant state of the water tank, the buoyant body is free from any water buoyancy so that the lower piston is opened to unblock the detergent outlet, while the upper piston is closed to block the detergent inlet. At this time, the detergent in the quantitative reservoir is released therefrom into the water tank.

Alternatively, in the water-saving and automatic detergent supplier, the buoyant piston structure includes an upper piston, a lower piston and a buoyant body. The upper piston is disposed on lower side of the detergent inlet of the quantitative reservoir, while the lower piston is disposed on upper side of the detergent outlet of the quantitative reservoir. The upper and lower pistons are both drivingly connected with the buoyant body. In a vacant state of the water tank, the buoyant body is free from any water buoyancy so that the upper piston is opened to unblock the detergent inlet, while the lower piston is closed to block the detergent outlet. At this time, the detergent is filled up into the quantitative reservoir. On the other hand, in a full level state of the water tank, due to water buoyancy, the buoyant body makes the upper piston block the detergent inlet, while opening the lower piston to unblock the detergent outlet. At this time, the detergent in the quantitative reservoir is released therefrom into the water tank.

The present invention can be best understood through the following description and accompanying drawings wherein:

DETAILED DESCRIPTION OF THE PREFERRED EMBODIMENTS

Figure 1:
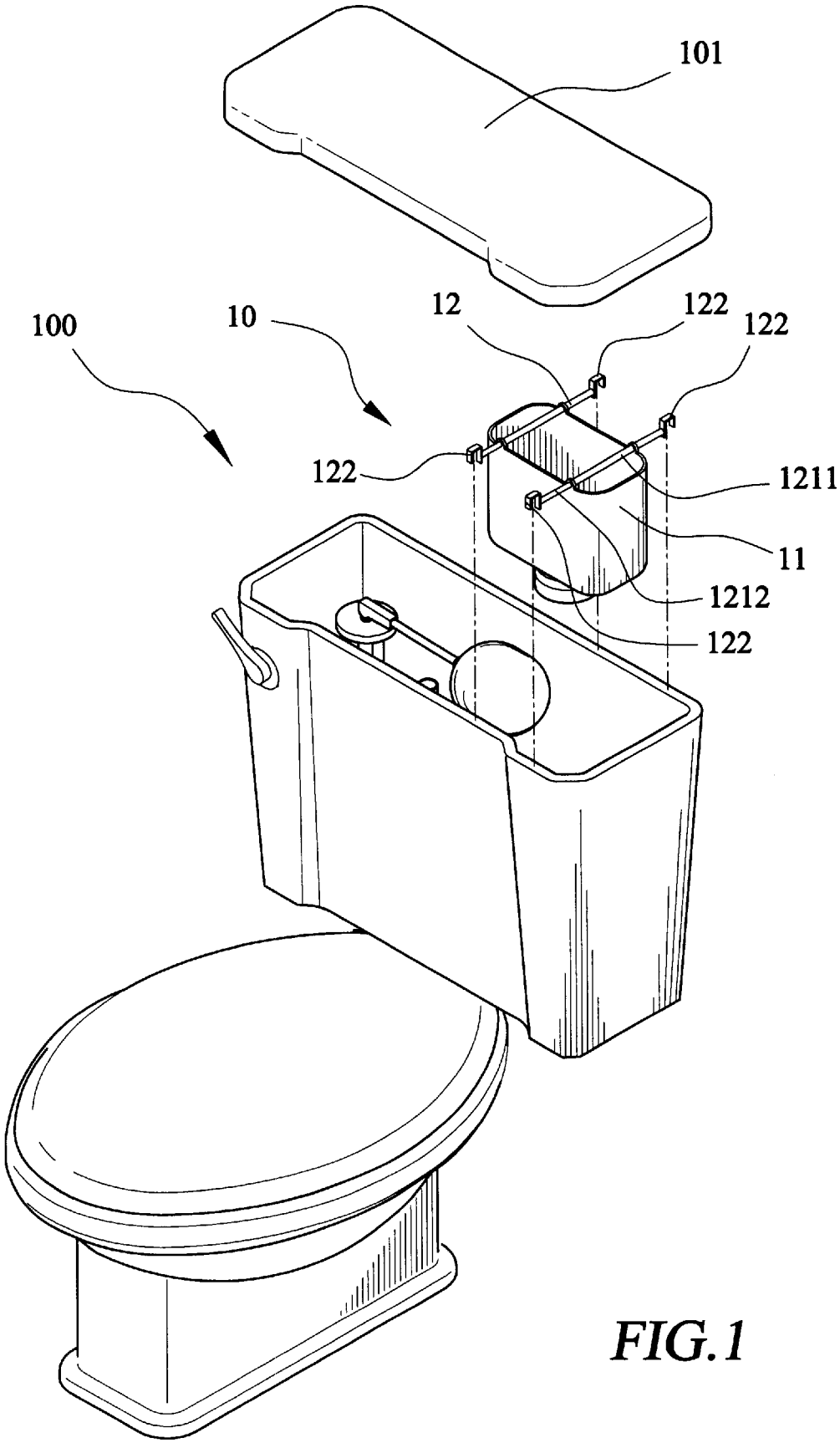
FIG. 1 is a perspective exploded view showing the position where the present invention is mounted on a water tank of a toilet bowl.
Figure 2:
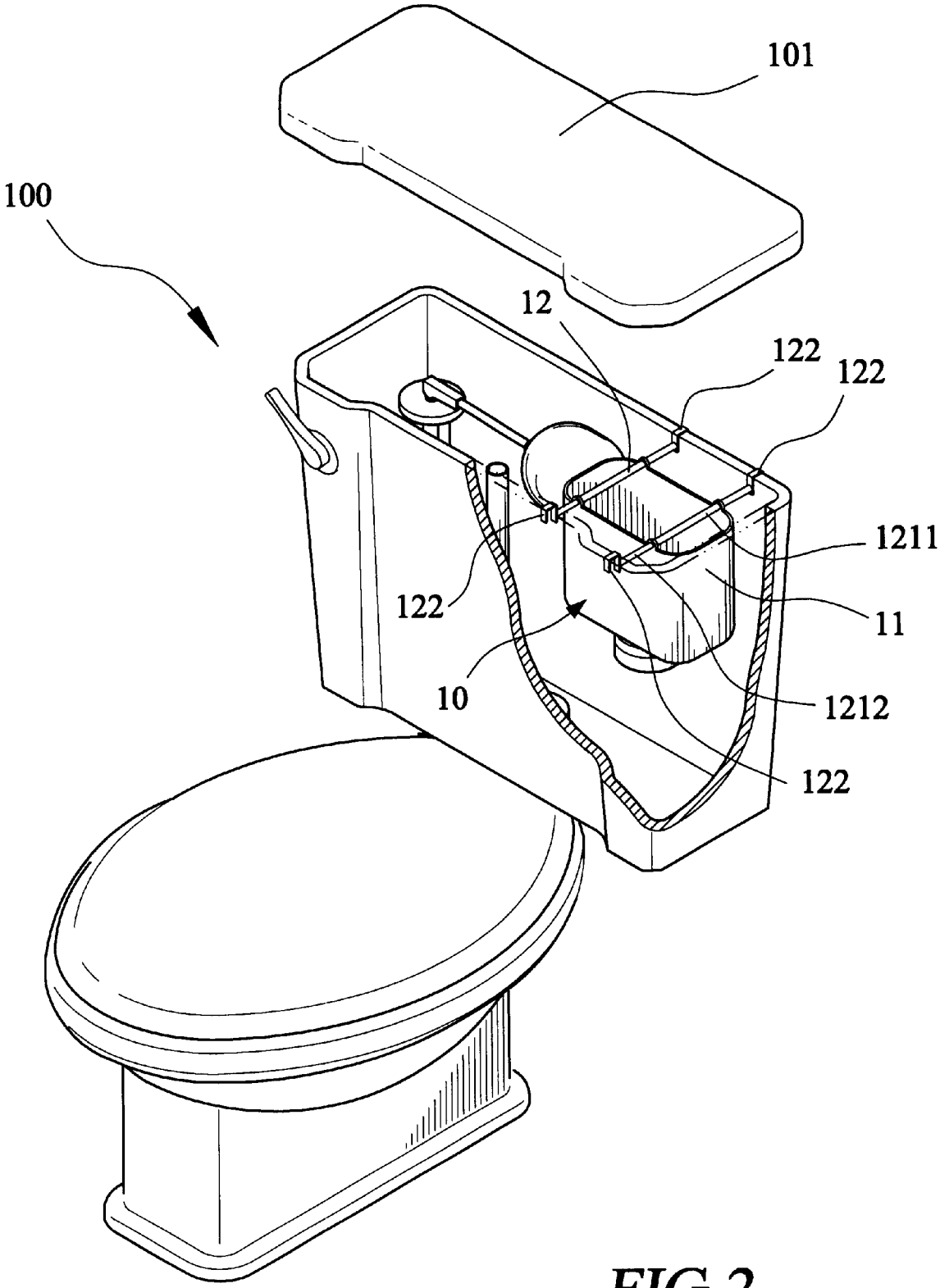
FIG. 2 is a perspective partially sectional view showing the position where the present invention is mounted on the water tank of the toilet bowl.

Please refer to FIGS. 1 and 2 which respectively are perspective exploded view and partially sectional view of the water tank of the toilet bowl according to a preferred embodiment of the present invention. The present invention includes a detergent supplier 10 disposed in the water tank 100 of the toilet bowl. The detergent supplier 10 has a detergent receptacle 11 which is a container having an upper opening. A detergent is contained in the detergent receptacle 11 for cleaning the toilet bowl. The detergent receptacle 11 is disposed on the water tank 100 with a lower half sinking in the water. The detergent receptacle 11 is fixed in a certain position in the water tank 100 by a fixing structure 12. Currently, in order to save the water for flushing the toilet bowl, a container such as a bottle filled up with water is placed in the water tank. The detergent receptacle 11 of the present invention serves to save water instead of such container placed in the water tank.

In this embodiment, the fixing structure 12 is composed of two fixing rods 121 connected across the top end of the detergent receptacle 11. Two reverse U-shaped hook members 122 are respectively disposed at two ends of each fixing rod 121 for hooking the peripheral wall defining the upper opening of the water tank. The upper cover board 101 of the water tank 100 presses the hook members 122, whereby the detergent receptacle 11 will not buoy up due to buoyant force of the water. In addition, the fixing rod 121 is comprised of an outer rod 1211 and an inner rod 1212 telescoped in the outer rod 1211. Accordingly, the length of the fixing rod 121 can be adjusted in accordance with the dimension or width of the water tank 100.

Figure 3:
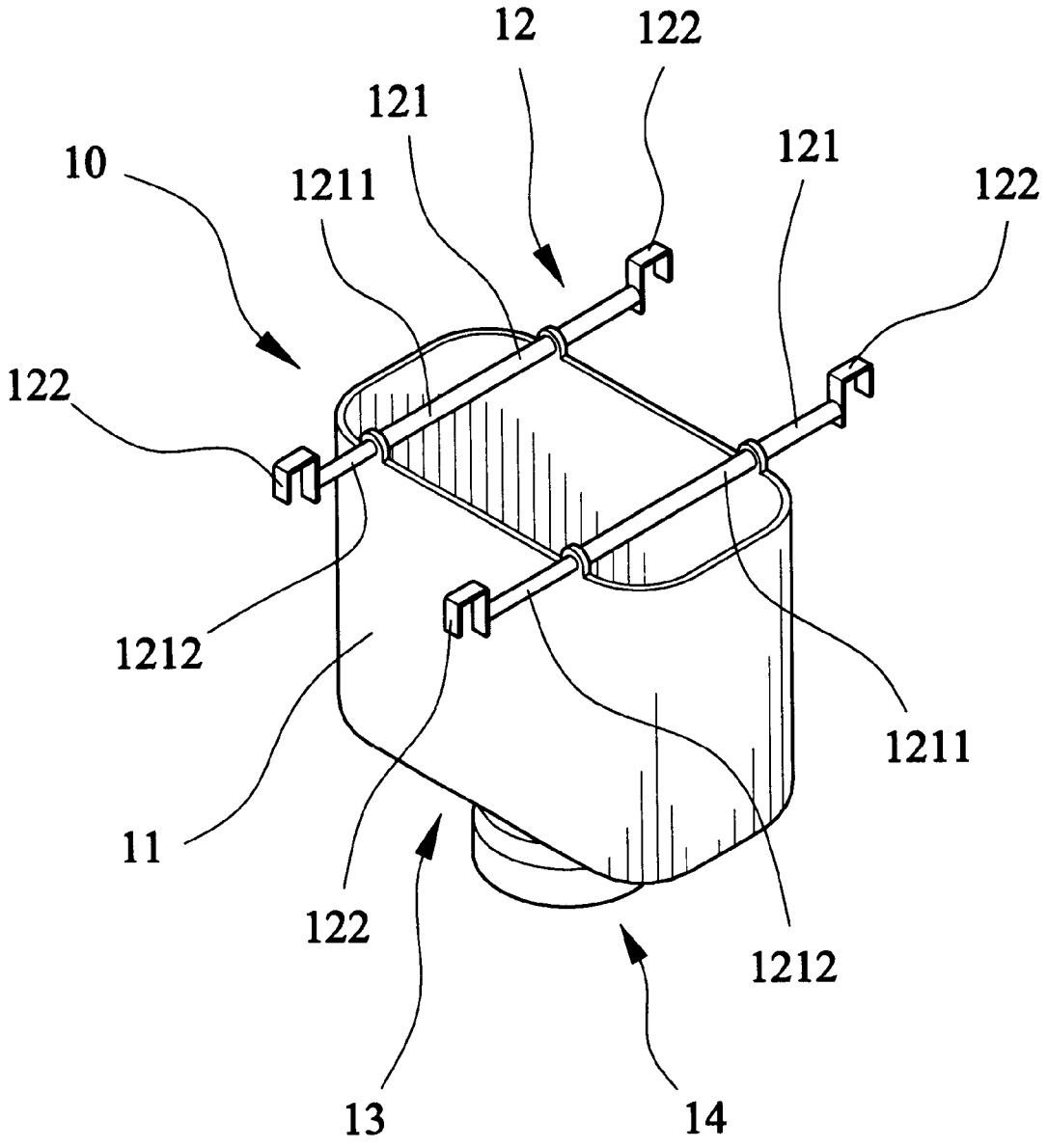
FIG. 3 is a perspective view of a first embodiment of the detergent supplier of the present invention.
Figure 4:
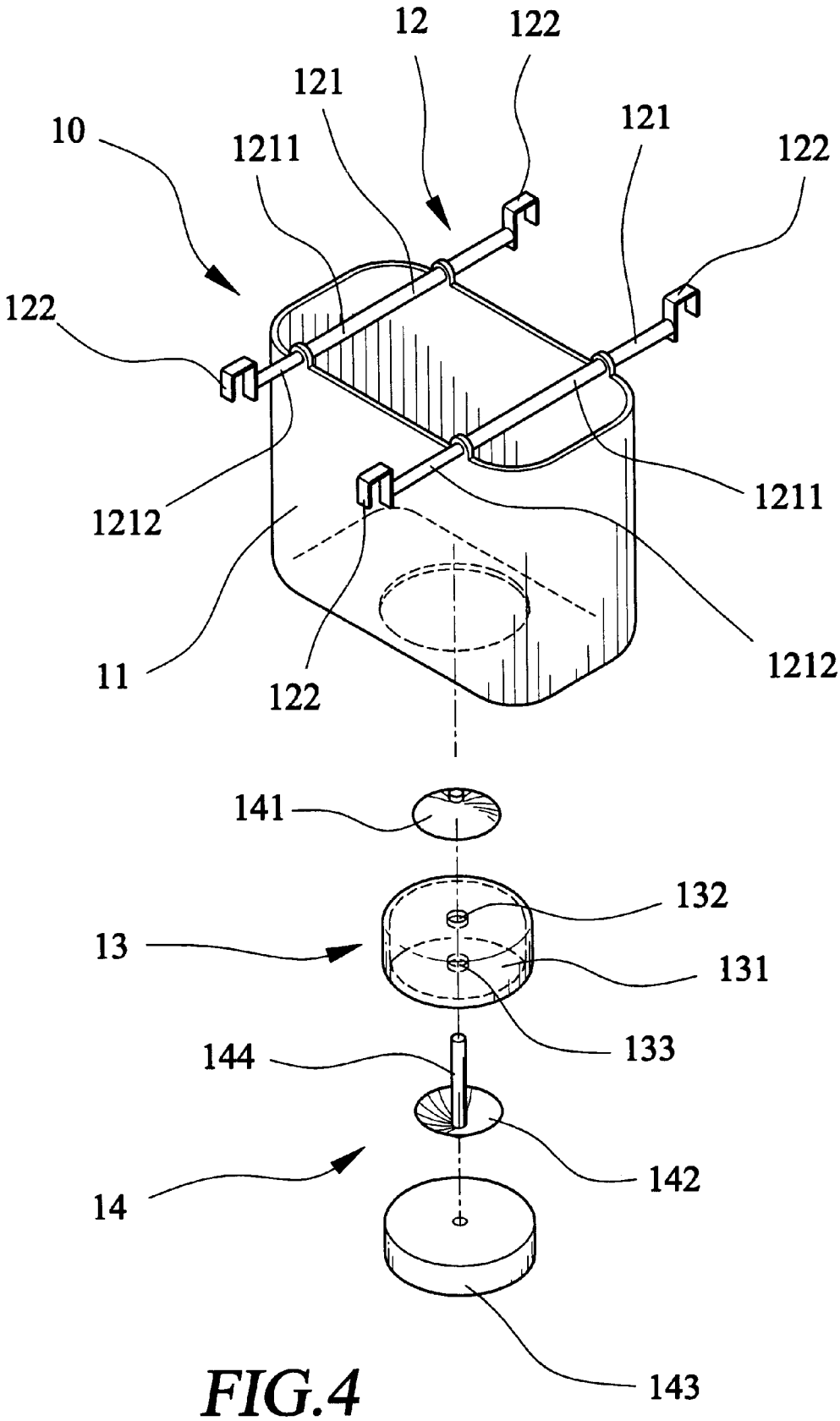
FIG. 4 is a perspective exploded view according to FIG. 3.

Please now refer to FIGS. 3 and 4. The detergent supplier 10 of the present invention further includes a quantitative reservoir 13 and a buoyant piston structure 14. The quantitative reservoir 13 is connected with the bottom of the detergent receptacle 11 and immersed in the water contained in the water tank 100. The quantitative reservoir 13 defines an interior space 131 for receiving therein a fixed amount of detergent. A top end of the quantitative reservoir 13 is formed with a detergent inlet 132, while a bottom end thereof is formed with a detergent outlet 133. The buoyant piston structure 14 is connected at the detergent inlet 132 and detergent outlet 133.

The buoyant piston structure 14 is subject to water buoyancy. Depending on the existence of water in the water tank 100 or vacancy of the water tank 100, the buoyant piston structure 14 is operable to release the detergent from the quantitative reservoir 13 into the water tank 100.

Figure 5:
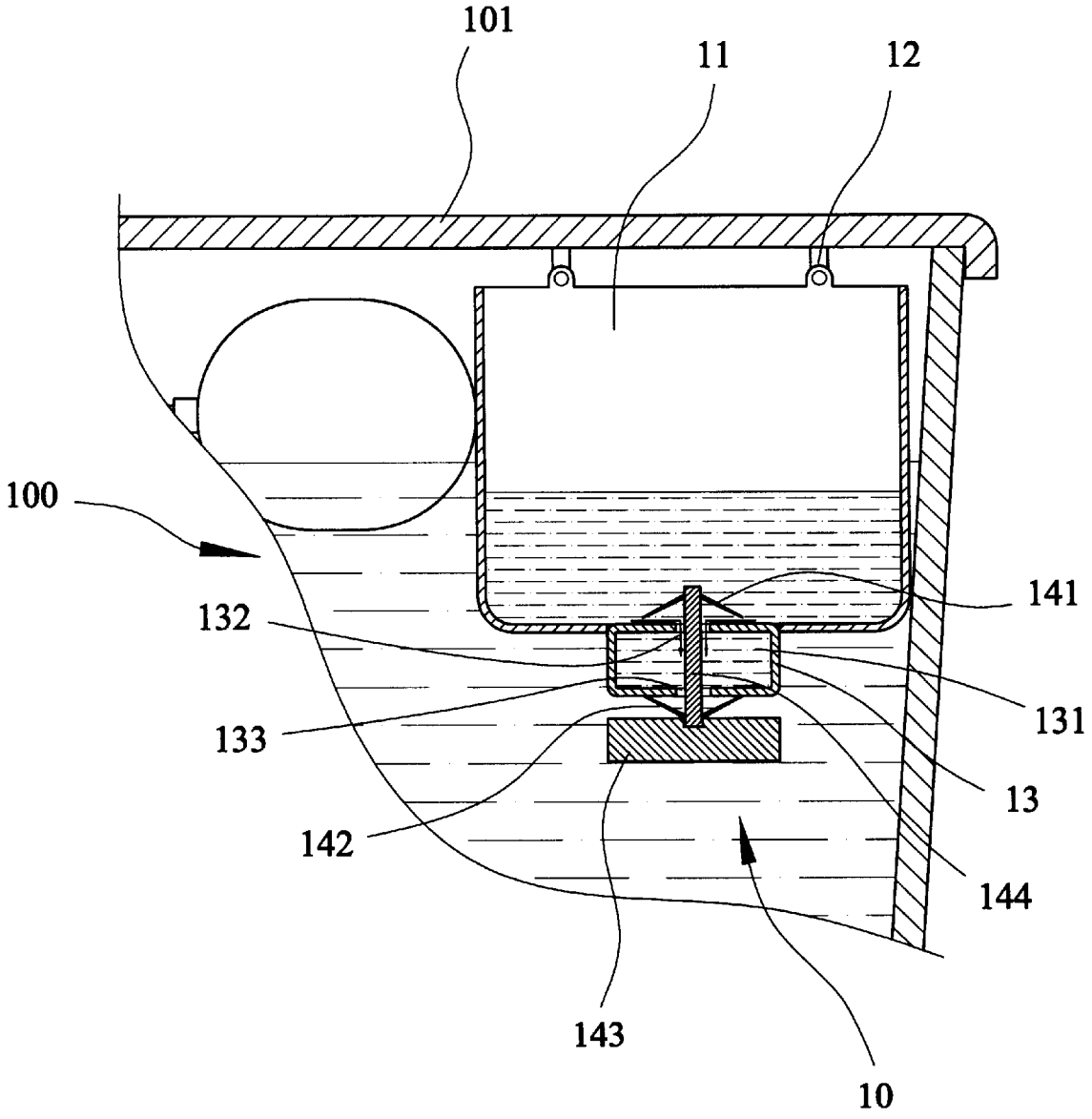
FIG. 5 is a sectional view of the first embodiment of the present invention in a full level state of the water tank.
Figure 6:
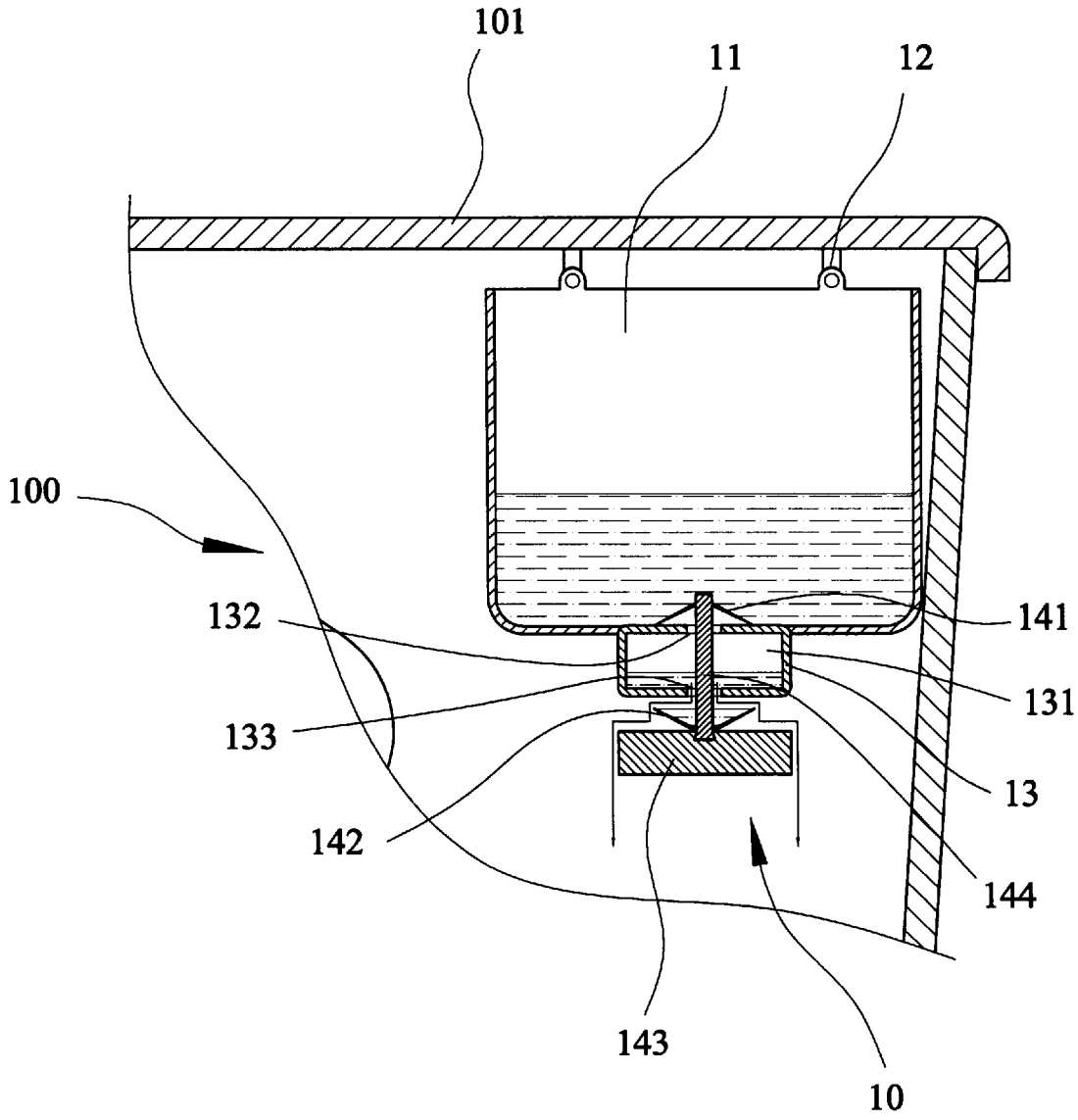
FIG. 6 is a sectional view of the first embodiment of the present invention in a vacant state of the water tank.

The buoyant piston structure 14 operates in a manner as follows:

Please refer to FIGS. 5 and 6 which respectively show the operation of the present invention in a full level state and a vacant state of the water tank. The buoyant piston structure 14 includes an upper piston 141, a lower piston 142 and a buoyant body 143 which are interconnected by a central stem 144 movable within the quantitative reservoir 13. The upper piston 141 is disposed on upper side of the detergent inlet 132 of the quantitative reservoir 13, while the lower piston 142 is disposed on lower side of the detergent outlet 133 of the quantitative reservoir 13. The upper and lower pistons 141, 142 are both drivingly connected with the buoyant body 143. In a fall level state of the water tank 100, due to water buoyancy, the buoyant body 143 makes the lower piston 142 block the detergent outlet 133, while opening the upper piston 141 to unblock the detergent inlet 132. Under such circumstance, the detergent is filled up into the quantitative reservoir 13. On the other hand, in a vacant state of the water tank 100, the buoyant body 143 is free from any water buoyancy so that the lower piston 142 is opened to unblock the detergent outlet 133, while the upper piston 141 is closed to block the detergent inlet 132. At this time, the detergent in the quantitative reservoir 13 is released therefrom into the water tank 100.

Figure 7:
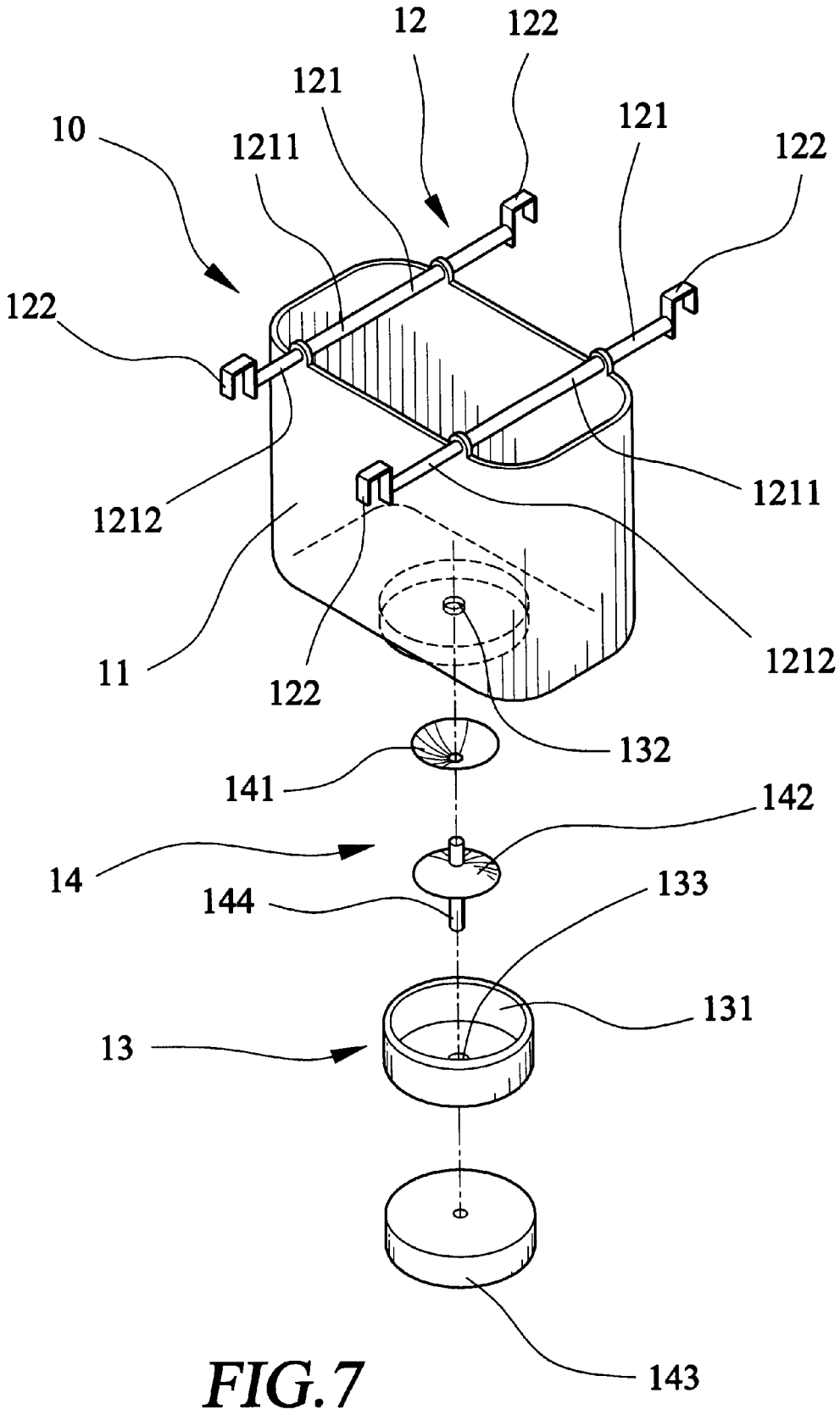
FIG. 7 is a perspective exploded view of a second embodiment of the present invention.

FIG. 7 shows a second embodiment of the present invention, in which the upper piston 141 of the buoyant piston structure 14 is disposed on lower side of the detergent inlet 132 of the quantitative reservoir 13, while the lower piston 142 is disposed on upper side of the detergent outlet 133 of the quantitative reservoir 13. Both the upper and lower pistons 141, 142 are drivingly connected with the buoyant body 143.

Figure 8:
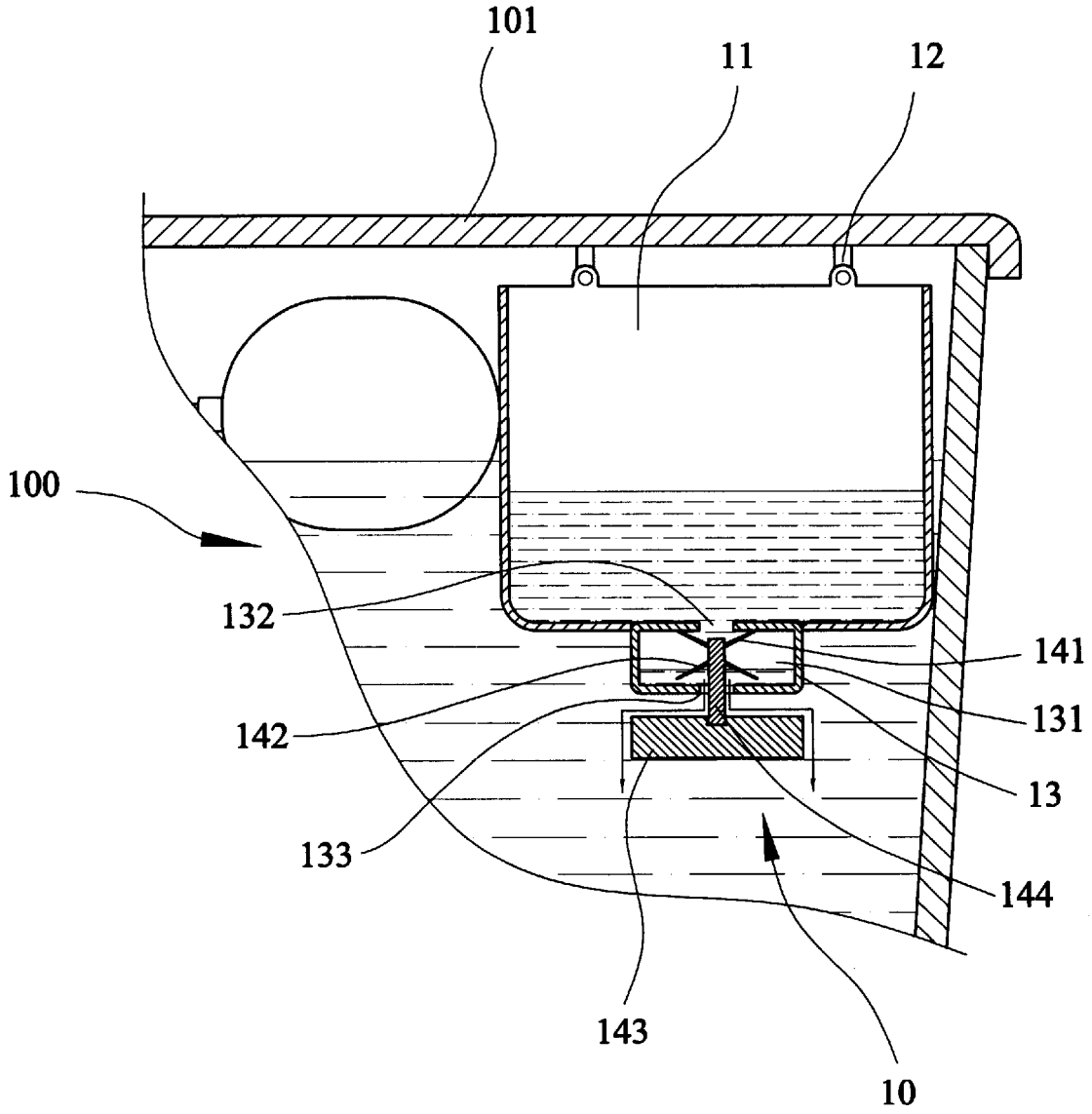
FIG. 8 is a sectional view of the second embodiment of the present invention in a full level state of the water tank.
Figure 9:
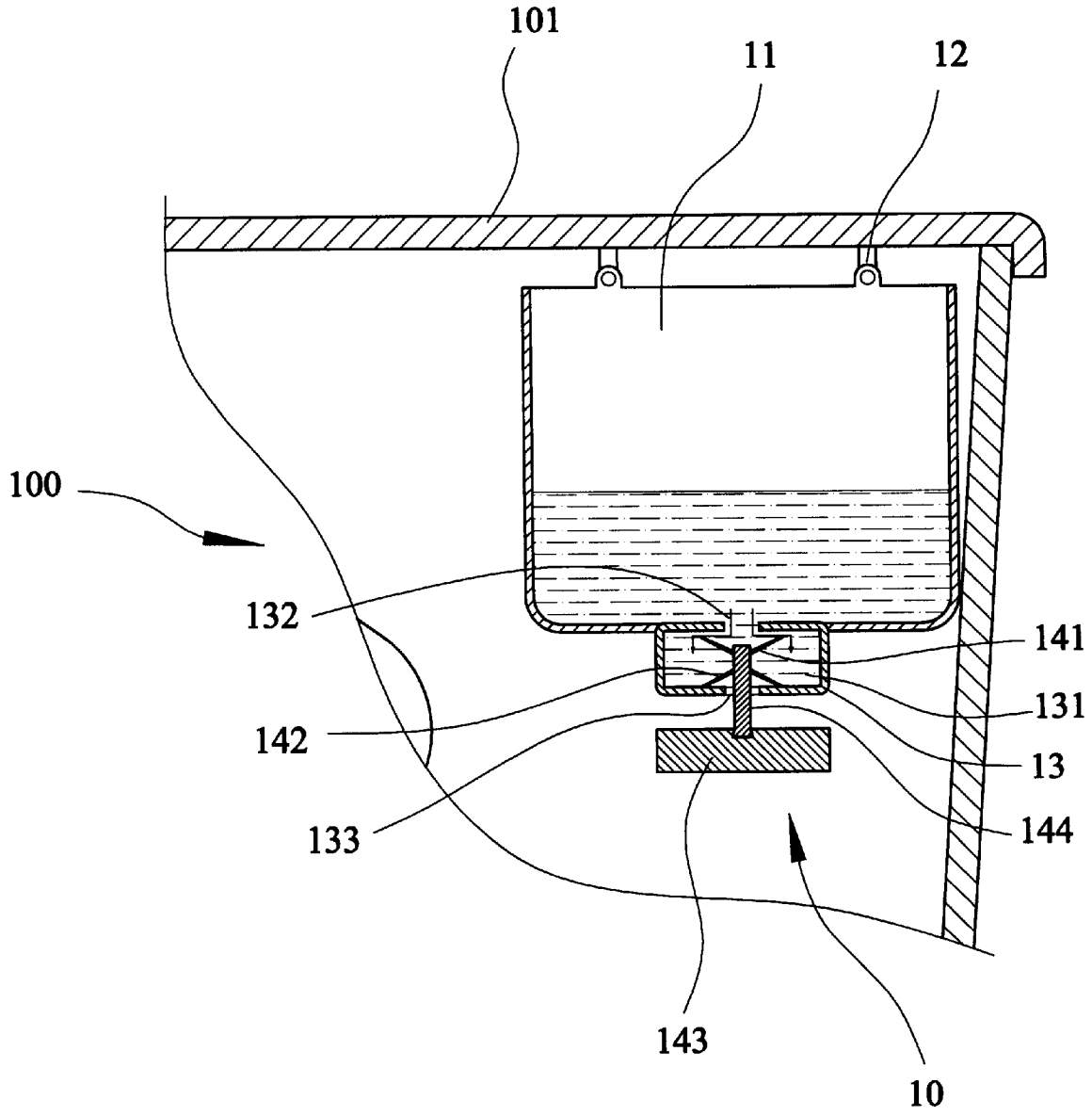
FIG. 9 is a sectional view of the second embodiment of the present invention in a vacant state of the water tank.

The buoyant piston structure 14 operates in a manner as shown by FIGS. 8 and 9. In a vacant state of the water tank 100, the buoyant body 143 is free from any water buoyancy so that the upper piston 141 is opened to unblock the detergent inlet 132, while the lower piston 142 is closed to block the detergent outlet 133. At this time, the detergent is filled up into the quantitative reservoir 13 as shown in FIG. 9. On the other hand, in a full level state of the water tank 100, due to water buoyancy, the buoyant body 143 makes the upper piston 141 block the detergent inlet 132, while opening the lower piston 142 to unblock the detergent outlet 133. At this time, the detergent in the quantitative reservoir 13 is released therefrom into the water tank 100 as shown in FIG. 8.

Both of the above embodiments of the present invention are able to supply a fixed amount of detergent into the water tank instead of the conventional detergent tablet. In addition, the present invention is able to save water as the conventional water-saving container.

The above embodiments are only used to illustrate the present invention, not intended to limit the scope thereof. Many modifications of the above embodiments can be made without departing from the spirit of the present invention.

What is claimed is:

1. A water-saving and automatic detergent supplier for a toilet bowl, comprising:

a detergent receptacle adapted to be disposed in a water tank of a toilet bowl, said detergent receptacle having an upper opening formed therethrough for receiving a detergent;

a reservoir fixedly secured to a bottom surface of said detergent receptacle and adapted to be immersed in water contained in said water tank, said reservoir defining an interior space for receiving therein a fixed amount of said detergent, a top end of said reservoir having a detergent inlet formed therethrough, a bottom end of said reservoir having a detergent outlet formed therethrough;

a buoyant piston structure received by said detergent inlet and said detergent outlet, said buoyant piston structure being buoyant in said water; and, a fixing structure having at least one fixing rod fixedly secured to a top end of said detergent receptacle, said fixing rod having a pair of opposed ends, each said end having a hook member formed thereon, said ho ok members removably engaging said water tank for securing said detergent receptacle within said water tank, whereby said buoyant piston structure selectively releases said detergent into said water tank dependent upon a level of said water in said water tank.

2. The water-saving and automatic detergent supplier for a toilet bowl as recited in claim 1, wherein said fixing structure is fixedly secured to said detergent receptacle for positioning said detergent receptacle in said water tank.

3. The water-saving and automatic detergent supplier for a toilet bowl as recited in claim 1, wherein said fixing rod comprises an outer rod and an inner rod telescoped in said outer rod such that a length of said fixing rod is adjustable in accordance with a dimension of said water tank.

4. The water-saving and automatic detergent supplier for a toilet bowl as recited in claim 1, wherein said buoyant piston structure comprises an upper piston, a lower piston and a buoyant body, said upper piston being disposed on an upper side of said detergent inlet of said reservoir, said lower piston being disposed on a lower side of said detergent outlet of said reservoir said upper piston and said lower piston connected to said buoyant body.

5. The water-saving and automatic detergent supplier for a toilet bowl as recited in claim 1, wherein said buoyant piston structure comprises an upper piston, a lower piston and a buoyant body, said upper piston being disposed on a lower side of said detergent inlet of said reservoir, said lower piston being disposed on an upper side of said detergent outlet of said reservoir, said upper piston and said lower piston connected to said buoyant body.

* * * * *